US010918167B2

(12) United States Patent
Prugue

(10) Patent No.: US 10,918,167 B2
(45) Date of Patent: Feb. 16, 2021

(54) FRICTION STOP STRAP ADJUSTOR

(71) Applicant: Bell Sports, Inc., Scotts Valley, CA (US)

(72) Inventor: Ximena Prugue, Santa Cruz, CA (US)

(73) Assignee: BELL SPORTS, INC., Scotts Valley, CA (US)

( * ) Notice: Subject to any disclaimer, the term of this patent is extended or adjusted under 35 U.S.C. 154(b) by 0 days.

(21) Appl. No.: 16/245,171

(22) Filed: Jan. 10, 2019

(65) Prior Publication Data

US 2019/0142113 A1 May 16, 2019

Related U.S. Application Data

(63) Continuation of application No. 15/238,600, filed on Aug. 16, 2016, now Pat. No. 10,188,177.

(60) Provisional application No. 62/206,093, filed on Aug. 17, 2015.

(51) Int. Cl.

| | |
|---|---|
| ***A44B 11/04*** | (2006.01) |
| ***A44B 11/18*** | (2006.01) |
| ***A42B 3/08*** | (2006.01) |

(52) U.S. Cl.

CPC ..... *A44B 11/18* (2013.01); *A42B 3/08* (2013.01); *A44B 11/04* (2013.01)

(58) Field of Classification Search

CPC ..... A44B 11/18; A44B 11/04; A44B 11/12; A42B 3/08

See application file for complete search history.

(56) References Cited

U.S. PATENT DOCUMENTS 3,192,587 A * 7/1965 White Paul W ..... A44B 11/04 24/200
4,044,400 A * 8/1977 Lewicki ..... A42B 3/08 2/421

(Continued)

FOREIGN PATENT DOCUMENTS

CH 701233 A 12/2010
EP 3590375 A1 1/2020

(Continued)

OTHER PUBLICATIONS https://www.youtube.com/watch?v=6_cFiUcgSks.

*Primary Examiner* — Jason W San
(74) *Attorney, Agent, or Firm* — Amardeep S. Grewal; Gerard M. Donovan; Reed Smith LLP

(57) ABSTRACT

A strap adjustor can include a first surface, a second surface opposite the first surface, and a third surface that extends between the first surface and the second surface. A first through opening can extend completely through the strap adjustor between the first surface and the second surface. A second through opening can extend completely through the strap adjustor between the first surface and the second surface. A can bar separate the first through opening and the second through opening. A first end opening can extend from the third surface to the first through opening, and a second end opening cab extend from the third surface to the first through opening. A first strap can be disposed through the first end opening. A second strap can be disposed through the second end opening. The first and second straps can be disposed through the first through opening and over the bar.

18 Claims, 11 Drawing Sheets

(56) References Cited

U.S. PATENT DOCUMENTS 4,171,555 A * 10/1979 Bakker ..... A44B 11/04 24/200
4,395,803 A * 8/1983 Krauss ..... A44B 11/04 24/200
4,525,901 A * 7/1985 Krauss ..... A44B 11/04 24/193
4,571,783 A * 2/1986 Kasai ..... A44B 11/04 24/169
4,637,099 A * 1/1987 Kasai ..... A44B 11/04 24/169
4,673,448 A * 6/1987 Bartolini ..... A41H 37/08 156/212
4,815,174 A * 3/1989 Sou ..... A01K 27/004 24/136 R
5,007,141 A * 4/1991 Gentes ..... A42B 3/08 2/421
5,077,839 A * 1/1992 Keller ..... A42B 3/08 2/421
5,083,321 A * 1/1992 Davidsson ..... A42B 3/066 2/421
5,123,121 A * 6/1992 Broersma ..... A42B 3/066 2/421
5,216,786 A * 6/1993 Anscher ..... A44B 11/04 24/200
5,243,741 A * 9/1993 Fudaki ..... A44B 11/04 24/197
5,245,731 A * 9/1993 Funathu ..... A44B 11/04 24/200
D344,610 S * 2/1994 Keller ..... D11/218
5,307,542 A * 5/1994 Murai ..... A44B 11/04 24/169
5,398,390 A * 3/1995 Hede ..... A42B 3/08 24/200
5,438,737 A * 8/1995 Anscher ..... A44B 11/2549 24/615
5,469,583 A * 11/1995 Akeley ..... A42B 3/08 2/421
5,608,918 A * 3/1997 Salvaggio ..... A42B 3/08 2/421
5,996,192 A * 12/1999 Haines ..... A44B 11/2549 24/615
6,311,338 B1 * 11/2001 Galet ..... A42B 3/08 2/421
6,463,638 B1 * 10/2002 Pontaoe ..... A44B 11/2549 24/163 R
7,178,175 B2 * 2/2007 Rogers ..... A42B 3/085 2/417
7,735,160 B1 * 6/2010 Schiebl ..... A42B 3/08 2/425
8,353,066 B2 * 1/2013 Rogers ..... A42B 3/085 2/417
9,155,347 B2 10/2015 Van Waes
9,433,259 B2 * 9/2016 Jacobsen ..... A42B 3/08
9,474,332 B1 * 10/2016 Naranjo ..... A44B 11/18
2004/0003452 A1 * 1/2004 Schiebl ..... A42B 3/08 2/421
2005/0210567 A1 * 9/2005 Rogers ..... A42B 3/085 2/421
2005/0241050 A1 * 11/2005 Pietrzak ..... A42B 3/08 2/421
2006/0032028 A1 * 2/2006 Takeuchi ..... A44B 11/04 24/197
2007/0017070 A1 * 1/2007 Kato ..... A44B 11/12 24/170
2007/0022577 A1 * 2/2007 Funo ..... A44B 11/04 24/196
2008/0078069 A1 * 4/2008 Pontaoe ..... A44B 11/04 24/196
2011/0239416 A1 * 10/2011 Shinya ..... A44B 11/04 24/457
2011/0247179 A1 * 10/2011 Bellamy ..... A61B 17/1327 24/19
2012/0297581 A1 * 11/2012 Pitman ..... A41F 15/002 24/200
2012/0324686 A1 * 12/2012 Ishii ..... A44B 11/12 24/68 E
2013/0219597 A1 8/2013 Van Waes
2014/0140784 A1 * 5/2014 Vick ..... F16B 2/20 410/97
2014/0317890 A1 10/2014 Koons et al.
2014/0338157 A1 * 11/2014 Iannello ..... A45F 5/00 24/318
2015/0113710 A1 * 4/2015 Jacobsen ..... A42B 3/08 2/421
2015/0272280 A1 * 10/2015 Muller ..... A44B 11/04 24/68 E
2017/0273378 A1 * 9/2017 Parker-Austin ..... A41F 15/002

FOREIGN PATENT DOCUMENTS

WO 200215979 A1 2/2002
WO WO2014046973 3/2014
WO 2015061002 4/2015

* cited by examiner

FRICTION STOP STRAP ADJUSTOR

RELATED APPLICATIONS

This application is a continuation of U.S. patent application Ser. No. 15/238,600 to Prugue, filed Aug. 16, 2016 titled "Friction Stop Strap Adjustor," which claims the benefit of U.S. provisional patent application 62/206,093, filed Aug. 17, 2015 titled "Friction Stop Strap Adjustor," the entirety of the disclosures of which are hereby incorporated by this reference.

TECHNICAL FIELD

This disclosure relates to a strap adjustor for use in strap adjustment. The friction stop adjustor can be employed on straps in myriad applications, including wherever a conventional strap adjustor is used, such as for releasably attaching a protective helmet to a head of a user.

BACKGROUND

Strap adjustors are used for devices, products, and items that include straps for the adjustment of the straps. Devices using straps can include protective gear, such as helmets, or other articles and devices including straps that require adjustment. Straps can be adjusted to increase or decrease an effective length of the strap, to bring together more than one strap and to customize a fit of the strap to the device or the user. Adjusting a length of straps can allow for improved fit between the strap, protective gear, helmet, or other article and the user.

FIG. 1A shows a plan view of a conventional one-piece strap adjustor 10, as known in the prior art. The conventional one-piece strap adjustor 10 has also been referred to as a strap slide, a adjustor 34, a slide lock strap adjustor, a conventional strap adjustor, and a strap adjustor. The conventional one-piece strap adjustor 10 can include a first opening 12 and a second opening 14, each of which are formed in and through the conventional one-piece strap adjustor and extend from a first surface to a second surface opposite the first surface. The first opening 12 and the second opening 14 can be integrally formed through a single material, thus making the conventional one-piece strap adjustor 10 a one-piece device. The first opening 12 and the second opening 14 can be thought of as being defined by an outer perimeter portion 16 and a center bar or middle bar 18. The outer perimeter portion 16 can be thought of as being defined by side rails or side portions 20 that are perpendicular or substantially perpendicular to the center bar 18. The outer perimeter portion 16 can also be thought of as being defined by a top rail 22 and a bottom rail 24 that are perpendicular or substantially perpendicular to the side rails 20, or stated another way, the top rail 22 and the bottom rail 24 can be parallel or substantially parallel to the center bar 18.

A width of the first opening 12 and the second opening 14 can comprise widths that are larger, or slightly larger than, widths of straps that will be disposed through the first opening 12 and the second opening 14. Similarly, heights of the first opening 12 and the second opening 14 can comprise heights that are larger, or slightly larger, than thicknesses of the straps that will be disposed through the first opening 12 and the second opening 14. FIG. 1B shows an example of how a first strap 20 and a second strap 22 can be threaded through the conventional one-piece strap adjustor 10.

FIG. 1B shows a perspective side view of a conventional one-piece strap adjustor 10 with a first strap 26 and a second strap 28 being inserted through, and extending between, the first opening 12 and the second opening 14. As shown in FIG. 1B, the first strap 26 and the second strap 28 can come into, and then exit, the conventional one-piece strap adjustor 10.

In addition to the conventional one-piece strap adjustor 10 shown in FIGS. 1A and 1B, other adjustors can also be used to receive and direct straps. These other adjustors include adjustors that have multiple pieces that can move with respect to each other, being pined, hinged, or moveably coupled together. An example of a multi-piece adjustor is a two-piece adjustor that allows two straps to pass from opposing first and second sides of the two-piece adjustor, wherein the first strap 26 and the second strap 28 would be held together by the two separate but attachable pieces of the adjustor being clamped together around the two straps to securely couple the straps to each other and to the two-piece adjustor.

SUMMARY

A need exists for a strap adjustor. Accordingly, in an aspect, a strap adjustor can comprise a first surface, a second surface opposite the first surface, and a third surface that extends between the first surface and the second surface. A first through opening can extend completely through the strap adjustor between the first surface and the second surface. A second through opening can extend completely through the strap adjustor between the first surface and the second surface. A bar can separate the first through opening and the second through opening. A first end opening can extend from the third surface to the first through opening. A second end opening can extend from the third surface to the first through opening.

The strap adjustor can also comprise the second end opening being offset and separate from the first end opening. A first strap can be disposed through the first end opening, through the first through opening, and over the bar. A second strap can be disposed through the second end opening, through the first through opening, and over the bar. The strap adjustor can further comprise an end opposite the third surface, the end comprising a channel, and the first strap and the second strap being disposed through the channel. A total angle of contact β between the first strap and the strap adjustor can comprise an angle in a range of 280°-310°. A centerline can extend through the first through opening, through the second through opening, and through the third surface between the first end opening and the second end opening. The strap adjuster can further comprise a first sidewall extending from the third surface to the end at an average angle with an absolute value in a range of 20° to 35° with respect to the centerline. Similarly, the strap adjuster can further comprise a second sidewall opposite the first sidewall and extending from the third surface to the end at an average angle with an absolute value in a range of 20° to 35° with respect to the centerline. A first strap can enter the first end opening at an angle substantially equal to the average angle of the first sidewall. A second strap can enter the second end opening at an angle substantially equal to the average angle of the second sidewall. The first strap and the second strap can exit the strap adjustor at an angle substantially equal to the centerline.

In another aspect, a strap adjustor can comprise a first surface, a second surface opposite the first surface, and a third surface that extends between the first surface and the second surface. A first through opening can extend from the first surface towards the second surface. A second through opening can extends through the strap adjustor from the first surface toward the second surface. A bar can separate the first through opening and the second through opening. A first end opening can extend from the third surface to the first through opening. A second end opening can extend from the third surface to the first through opening.

The strap adjustor can further comprise the second end opening being offset and separate from the first end opening. A first strap can be disposed through the first end opening, through the first through opening, and over the bar. A second strap can be disposed through the second end opening, through the first through opening, and over the bar. The strap adjustor can further comprise an end opposite the third surface, the end comprising a channel. The first strap and the second strap can be disposed through the channel. A total angle of contact β between the first strap and the strap adjustor can comprise an angle in a range of 280°-310°. The strap adjustor can further comprise a centerline extending through the first through opening, through the second through opening, and through the third surface between the first end opening and the second end opening. A first sidewall can extend from the third surface to the end at an average angle in a range of 20° to 35° with respect to the centerline. A second sidewall opposite the first sidewall can extend from the third surface to the end at an average angle in a range of −20° to −35° with respect to the centerline. A first strap can enter the first end opening at an angle substantially equal to the average angle of the first sidewall. A second strap can enter the second end opening at an angle substantially equal to the average angle of the second sidewall. The first strap and the second strap can exit the strap adjustor at an angle substantially equal to the centerline.

In another aspect, a strap adjustor can comprise a first end comprising a first end opening and a second end opening offset from the first end opening. The strap adjustor can comprise a second end opposite the first end comprising a channel. A centerline can extend through a middle of the first end and a middle of the second end. A first sidewall can extend from the first end to the second end at an angle in a range of −20° to −35° with respect to the centerline. A second sidewall opposite the first sidewall can extend from the first end to the second end at an angle in a range of 20° to 35° with respect to the centerline.

The strap adjustor can further comprise a first through opening, wherein the first end opening and the second end opening extend to, and are substantially perpendicular with respect to the first through opening. The strap adjustor can further comprise a second through opening, and a bar separating the first through opening and the second through opening. A first strap can be disposed through the first end opening, through the first through opening, and over the bar. A second strap can be disposed through the second end opening, through the first through opening, and over the bar. A total angle of contact between the first strap and the strap adjustor can comprise an angle in a range of 280°-310°.

DETAILED DESCRIPTION

Figure 1A:
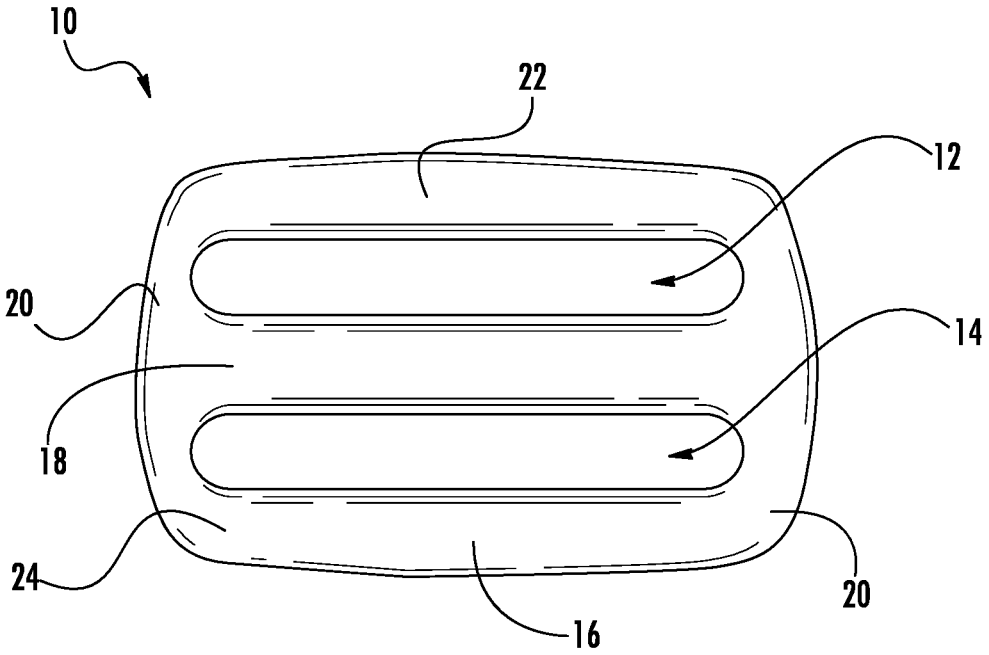
FIG. 1A PRIOR ART
FIGS. 1A and 1B show a view of a strap slide, slide lock strap adjustor, or conventional one-piece strap adjustor as known in the prior art.

This disclosure, its aspects and implementations, are not limited to the specific helmet, strap or strap adjustor material types, or other system component examples, or methods disclosed herein. Many additional components, manufacturing and assembly procedures known in the art consistent with helmet manufacture are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity and because one of ordinary skill in the art will understand the breadth of various other alternate examples from the disclosure and alternative examples provided herein.

While this disclosure includes a number of embodiments in many different forms, there is shown in the drawings and will herein be described in detail, particular embodiments with the understanding that the present disclosure is to be considered as an exemplification of the principles of the disclosed methods and systems, and is not intended to limit the broad aspect of the disclosed concepts to the embodiments illustrated.

This disclosure provides a system and method for adjusting one or more straps, including helmet straps or straps for protective gear, such as helmet straps for a cyclist, football player, hockey player, baseball player, lacrosse player, polo player, climber, auto racer, motorcycle rider, motocross racer, skier, snowboarder or other snow or water athlete, sky diver or any other athlete in a sport or other person who is in need of protective head gear. Strap adjustment for helmets can further include other industries that use protective headwear, such as a construction, soldier, fire fighter, pilot, or other worker in need of a safety helmet, where similar straps and methods of strap adjustment are needed. More broadly, strap adjustment of bags, backpacks, satchels, other protective equipment including goggles, glasses, slings, pads, shin guards, chest protectors, or other clothing, equipment, gear, or luggage is also contemplated. Similarly, other applications including marine applications, or any application with straps, rope, cords, webbing, or similar devices is also contemplated. While various embodiments are discussed below with respect to two straps, the adjustor can be configured to receive any number of straps, including one thicker strap, or more than two straps. As such, the term "straps" is used throughout the specification, for convenience, to denote embodiments in which one strap or a plurality of straps can be used.

Figure 1B:
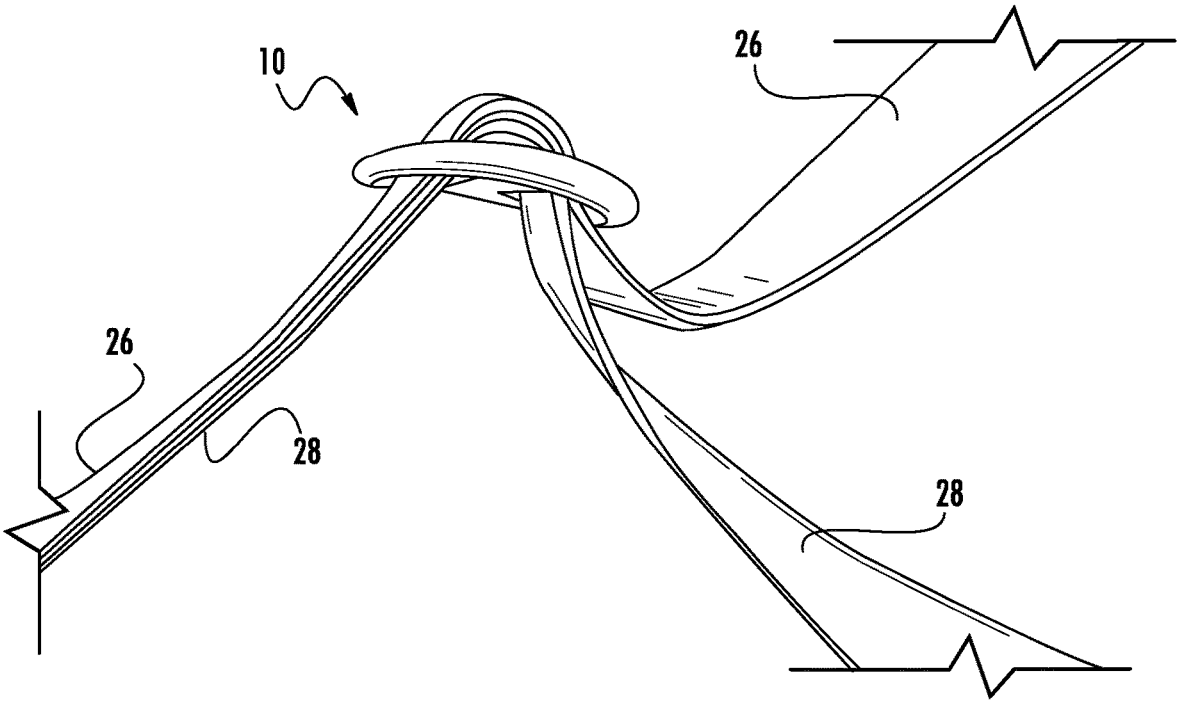
FIG. 1B PRIOR ART

Applicant has recognized that a difficulty of conventional strap adjustors, such as strap adjustor 10 shown in FIGS. 1A and 1B, is that the first strap 26 and the second strap 28 being fed through a first side of the conventional strap adjustor 10 have a tendency to loosen and move in relation to the conventional strap adjustor 10, and also move in relation to other objects such as a user's ear, around which the first strap 26 an the second strap 28 can be disposed. As shown in FIGS. 1A and 1B, the two straps 26, 28 can be fed over the center bar 18 of the conventional adjustor 10, and a location of the conventional adjustor 10 relative to an object, such as a user's ear can be fixed or set. When the straps 26, 28 are not in tension, such as when a helmet is not being worn or is in a bag, the straps 26, 28 can bow around the center bar 18 of the conventional strap adjustor 10 so that the conventional strap adjustor 10 is no longer held in place by the interaction of the center bar 18 and the outside bars or perimeter portion 16 of the conventional strap adjustor 10. In this condition, the conventional strap adjustor 10 will typically move relative to the one or more straps 26, 28, and relative to a location of the user, such as the ear of the user. Additionally, a conventional strap adjustor 10 can creep or move relative to the one or more straps 26, 28 even when the straps 26, 28 are in tension or under some loading, such as when straps from opposing sides of the helmet are buckled. External factors, such as sweat, rain, normal aging of the straps, and other outside elements can make the straps 26,28 more slippery, especially over time, and allow for creeping of conventional adjustors even when in use or on straps in tension.

Figure 2:
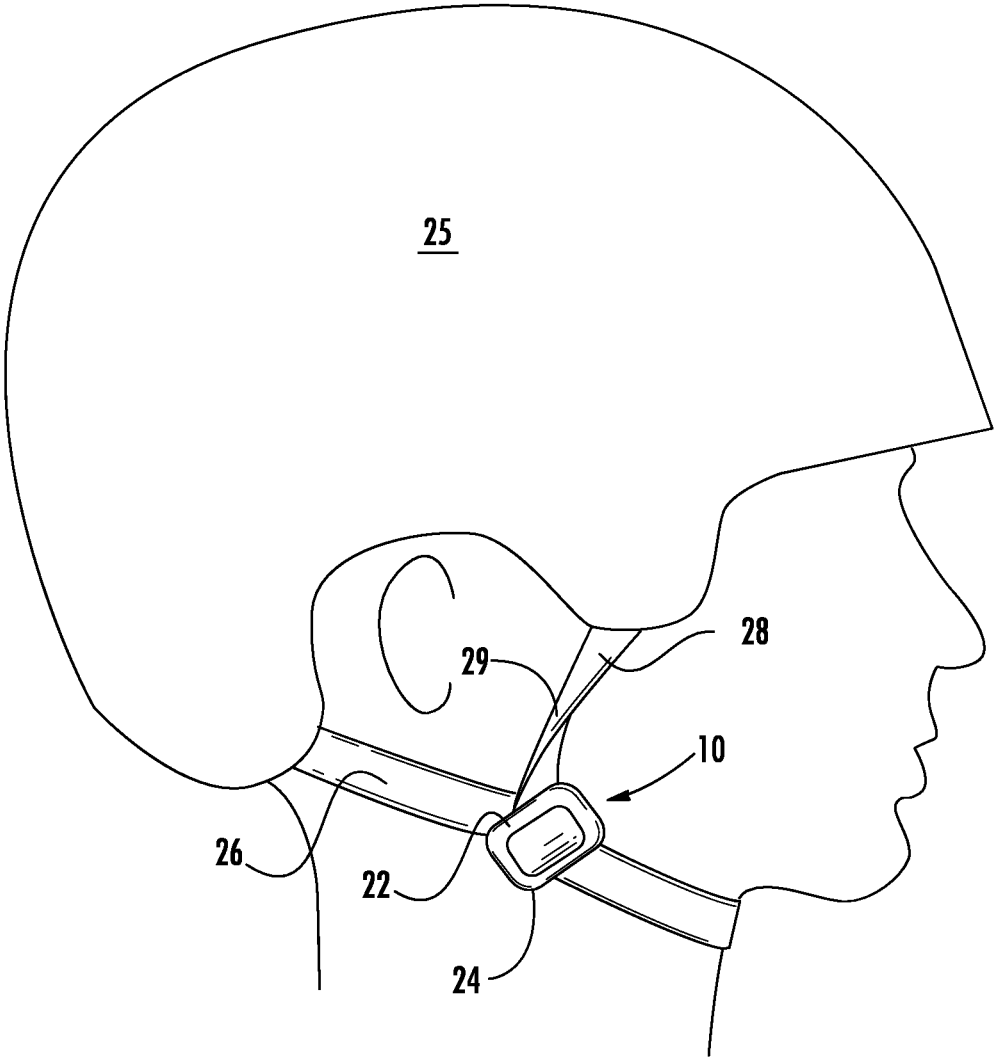
FIG. 2 shows conventional one-piece strap adjustor coupled to straps and a helmet.

FIG. 2 shows a side view of a user wearing a helmet 25 with first and second straps 26, 28, or pieces of webbing extending from the helmet 25 and then joined together using the conventional adjustor 10. The conventional adjustor 10 is being used to hold the two straps 26, 28 together, and to align the portions of the first strap 26 and the second strap 28, between the conventional adjustor 10 and the distal ends of the first and second straps 26, 28, which can extend below a user's chin as shown in FIG. 2. As shown in FIG. 2, the conventional adjustor 10 receives the first and second straps 26, 28, which extend from the helmet 25 at different angles (relative to the conventional adjustor 10), and enter into the first opening 12 at a first end of the conventional adjuster 10, by passing under the top rail 22. The straps 26, 28 then pass out of the conventional adjustor 10 at the second opening 14 located at a second end of the conventional adjustor 10, opposite the first end, by passing under the bottom rail 24. When the straps 26, 28 pass out of the second opening 14 and under the bottom rail 24, the first and second straps 26, 28 can exit at a same angle relative to the conventional adjustor 10 and be stacked one on top of the other. Applicant has observed that by passing the first and second straps 26, 28 in through the first opening 14 from different angles or orientations, aligning the first strap 26 and second strap 28 can cause one or more twists 29 to develop in the straps 26, 28 outside, adjacent, or away from the conventional adjustor 10 as shown in FIG. 2. The twist(s) 29 can be uncomfortable, unsightly, and disruptive to moving the straps 26, 28 through the conventional adjustor 10. Furthermore, the twist(s) 29 in the straps 26, 28 can also increase drag or a force applied to the straps 26, 28 by wind loading, and can further create unwanted noise by magnifying a sound of the wind against the straps 26, 28, which can make a user's task of listening for cars or other moving objects more difficult because of increased ambient noise. As such, Applicant's new friction-stop adjustor (FS S adjustor), tri-glide friction strap adjustor, tri-rap strap adjustor, or "adjustor" 34 can reduce or alleviate unwanted twists 29 in straps 26, 28, in drag, and in noise.

Figure 3:
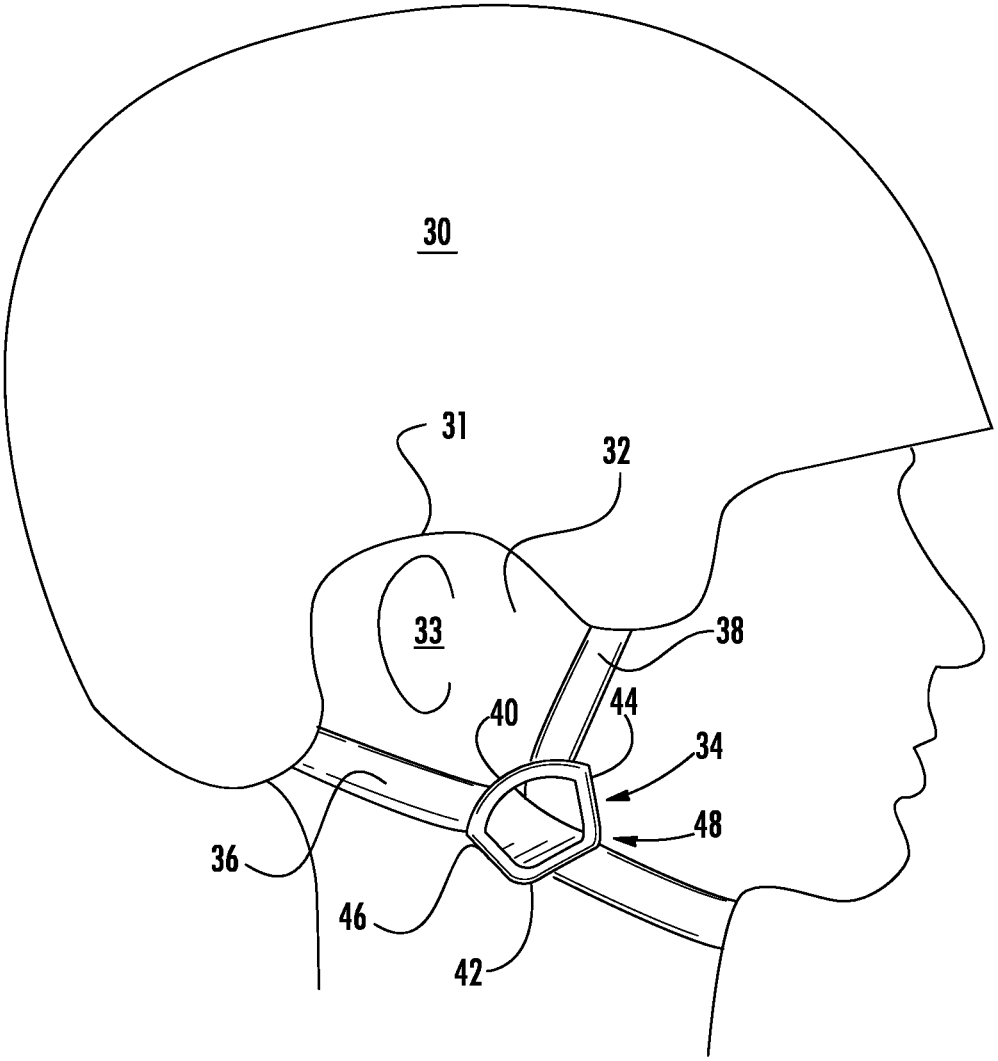
FIG. 3 shows an embodiment of a friction stop strap adjustor coupled to straps and a helmet.

FIG. 3 shows a side view of a user 32 wearing a helmet 30 and the adjustor 34 coupled to the helmet 30 with a first strap 36 and a second strap 38 to releasably couple the helmet 30 to a head of a user 32, wherein the adjuster 34 can be disposed below an ear 33 of the user 32. For convenience and ease of description, a number of relative positional descriptors, such as "upper," "lower," "front," "rear," "top," and "bottom" are used by way of illustration and not by way of limitation.

With respect to the orientation descriptors for the adjustor 34 shown in FIG. 3, the "upper" surface or end 40 of the adjustor 34 is the surface or end that is closest to the upper edge of FIG. 3, or the top of the head of the user 32. The "lower" surface or end 42 of the adjustor 34 is the surface or end that is closest to the lower edge of FIG. 3, the chin, the neck, or the body of the user 32, and is opposite the upper surface 40 of the adjustor 34. The "front," "frontside," "front surface," or sidewall 44 of the adjustor 34 is the surface or edge that is closest to the front of the helmet 30, or the closest the face of the user 32. FIG. 3 shows the right side of the user 32, and as such the front side 44 of the adjustor 34 is shown at the right of the adjustor 34 in FIG. 3. The "back," "backside," "back surface," or sidewall 46 of the adjustor 34 is the surface or edge that is closest to the rear of the helmet 30, or the occipital region of the head of the user 32. As shown in FIG. 3, the backside 46 of the adjustor 34 is opposite the front side 44 of the adjustor 34 such that the backside 46 of the adjustor 34 is shown at the left of the adjustor 34 as pictured in FIG. 3. The "top," "top side," or "top surface" 48 of the adjustor 34 is the side of the adjustor 34 bordered by the upper surface 40, the lower surface 42, the front surface 44, and back surface 46 of the adjustor 34, and can be perpendicular or substantially perpendicular to the upper surface 40, the lower surface 42, the front surface 44, and back surface 46. The top side 48, as shown in FIG. 3, is the side that is disposed facing away from the user 32 when in normal use. For example, the top side 48 of the adjustor 34 will be oriented facing away from the head of the user 32 when the adjustor 34 is worn in conjunction with the helmet 30 and the first strap 36 and the second strap 38. Conversely, as used herein, the "bottom," "bottom side," or "bottom surface" 49 of the adjustor 34 is the side of the adjustor 34 that is opposite the top side 48, and as such the back side 49 will be disposed towards the user 32 when in normal use. For example, the bottom 49 of the adjustor 34 will be oriented towards, or may contact, the head of the user 32 head when the adjustor 34 is worn in conjunction with the helmet 30 and the first strap 36 and the second strap 38.

While the adjustor 34 can, for convenience, be referred to as a friction stop adjustor, some slippage or relative movement between the adjustor 34 and either or both of the first strap 36 and the second strap 38 is still possible with the stopping induced by the adjustor 34. As used herein, the term friction stop as used with respect to the adjustor 34 can mean that slippage or relative movement between the adjustor 34 and the first strap 36 and the second strap 38, can be minimal, de minimis, negligible, or reduced with respect to the conventional one-piece strap adjustor 10 and the first strap 26 and the second strap 28. Due to particular features of the adjustor 34, which are discussed in greater detail below, the first strap 36 and the second strap 38 do not have a tendency to loosen and move relative to each other or relative to the adjustor 34 as is the case with the conventional one-piece strap adjustor 10 and the first strap 26 and the second strap 28 if there is not constant tension applied to the first strap 36 and the second strap 38.

FIG. 3 shows that the adjustor 34 can be used to hold one or more straps together, such as one strap, two straps, a plurality of straps, or any number of straps, and can additionally be used to align the straps in an arrangement, alignment, or position that is desirable or advantageous for the user 32. While various embodiments are discussed herein with respect to the first strap 36 and the second strap 38, the adjustor 34 can also be configured to receive any number of straps, including one thick strap, or a plurality of straps. As such, the term "straps" is used throughout the specification, for convenience, to denote embodiments in which one strap or a plurality of straps can be used. Whatever the number of straps, the straps can be made of rope, cord, twine, webbing, fabric, or any other suitable braided, twisted, woven, pressed, planar, or laminar material comprising, fabric, plastic, resin, fiber, polymer, or other suitable material. As a non-limiting example, the first strap 36 and the second strap 38 can comprise nylon webbing.

As a non-limiting example, FIG. 3 shows an embodiment in which two different straps, the first strap 36 and the second strap 38, can be attached or coupled to the helmet 30. The first strap 36 can be attached toward a rear portion of the helmet 30 on a rear or first side of an ear opening 31 and the second strap 38 can be attached toward a front of the helmet 30 on a second side of the ear opening 31 so that the first strap 36 and the second strap 38 can be separated by the ear opening 31. The adjustor 34 can also be configured to receive the first strap 36 and the second strap 38 at different relative angles. For example, the adjustor 34 can comprise a centerline 50 extending through a first through opening 52, through a second through opening 54, and through a separator or bar 59 at, or as part of, the upper surface 40 between a first end opening 56 and a second end opening 58. The centerline 50 can also extend through a middle of the upper end 40 and a middle of the lower end 42. A first sidewall 44 can extend from the upper surface 40 to the end 42 at an average angle $\theta_1$ in a range of −20° to −35° with respect to the centerline 50, and a second sidewall 46 opposite the first sidewall and extending from the upper surface 40 to the end 42 at an average angle $\theta_2$ in a range of −20° to −35° with respect to the centerline 50, as shown, e.g., in FIG. 4B, where angles measured in a counterclockwise direction with respect to the centerline 50 are positive, and angles measured clockwise with respect to the centerline 50 are negative. Alternatively, and absolute value of the angles $\theta_1$ and $\theta_2$ can be in a range of 20° to 35°. The first strap 36 can enter the first end opening 56 at an angle substantially equal to the average angle $\theta_1$ of the first sidewall 46. Similarly, the second strap 38 can enter the second end opening 58 at an angle substantially equal to the average angle $\theta_2$ of the second sidewall 44.

After entering the adjustor 34, the first strap 36 and the second strap 38 can pass out of the adjustor 34 at the lower surface or end 42 of the adjustor 34 opposite the upper surface or end 40. When the straps 36, 38 pass out of the adjustor 34 near lower surface or end 42, the first strap 36 and the second strap 38 can exit at a same angle or substantially same angle relative to the adjustor 34 and be stacked on top of each other. The first strap 36 and the second strap 38 can exit the adjustor 34 at an angle substantially equal to the centerline 50, such as within plus or minus 0-10° or 0-5°. As such, the adjustor 34 can receive straps from different portions of the helmet 30 and align the straps into a single direction for a safe and comfortable fit with the head of the user 32. Additionally, the strap adjustor 34 can be used to adjust one or more of a length, position, or orientation of helmet straps to suitably position and couple the first strap 36 and the second strap 38 into place below a chin or jaw of the user 32 to keep the helmet 30 secured to the head of the user 32 while wearing the helmet 30.

The first strap 36 can be disposed through the first end opening 56, through the first through opening 52, and over a bar 60. The bar 60 can separate the first through opening 52 and the second through opening 54, as well as extend between the front 44 and the back 46 of the adjustor 34. The second strap 38 can be disposed through the second end opening 58, through the first through opening 52, and over the bar 60.

Figure 4A:
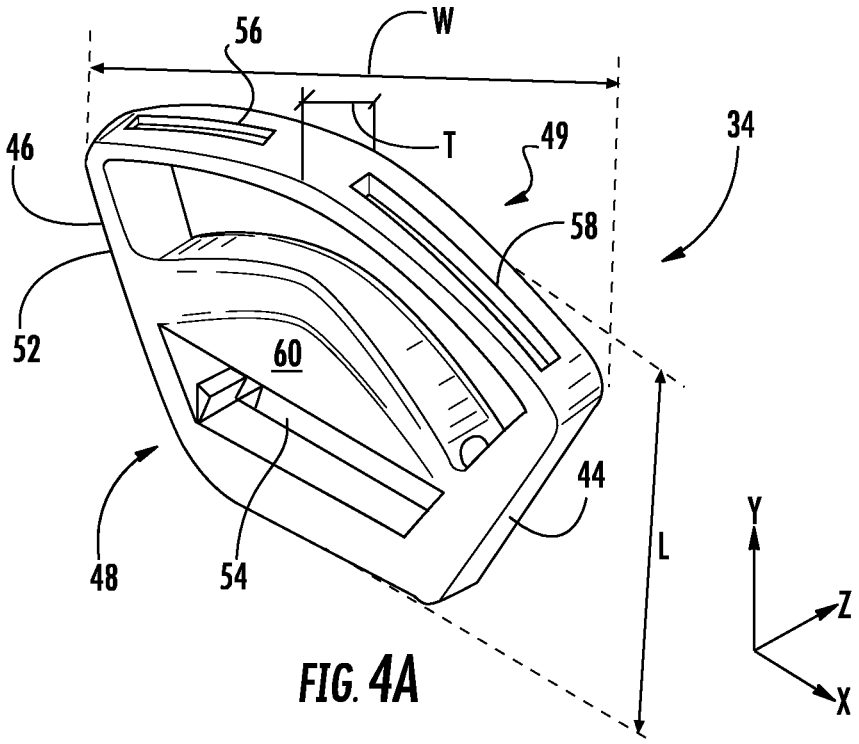
FIGS. 4A-4I show various views of an embodiment of a friction stop strap adjustor

Additional detail of the adjustor 34 is now discussed below with respect to the various views of the adjustor 34 shown in FIGS. 4-4I. FIG. 4A shows a perspective view of an embodiment of the adjustor 34, with the top surface 48 being most prominently displayed, the upper surface 40 positioned at the upper portion of the page, the front 44 positioned at the right of the page, and the back 46 positioned at the left of the page. The length L of the adjustor 34 is shown as a distance between the upper surface 40 and the lower surface 42, and corresponds to a y-direction in a conventional Cartesian coordinate system. Similarly, a width W corresponds to a distance between the front surface 44 and the back surface 46, and corresponds to an x-direction in a conventional Cartesian coordinate system. A height H, which can also be considered a thickness or depth of the adjustor 34, is shown as the distance between top surface 48 and the bottom surface 49, and corresponds to a z-direction in a conventional Cartesian coordinate system. As shown, the x-direction, y-direction, and z-direction can all be perpendicular or orthogonal to each other. However, the orientation of the adjustor 34 with respect to the x, y, and z directions are for convenience, are non-limiting, and can be reversed or modified without departing from the scope of the disclosure.

The adjustor 34 can be manufactured using a desired manufacturing process, such as through molding, injecting molding, or other molding process to form the adjustor 34 as a single integrally formed piece or body to be a one-piece adjustor 34. The adjustor 34 can be made of any suitable material or combination of materials, including metal, plastic, resin, polymer, acrylic, or fiber, including polycarbonate (PC), polyethylene (PE), polyethylene terephthalate (PET), polyvinyl chloride (PVC), vinyl nitrile (VN), or other suitable or similar material.

In some instances, the adjustor 34 can comprise one or more portions with a roughened or textured surface, such as the bar 60, that can include raised portions, ribs, ridges, teeth, grooves, channels, bumps, divots, or other feature that can be added to adjust or control the friction, coefficient of friction, or resistance between the bar 60 and the first strap 36, or the second strap 38, as well as an ease of adjustment or an amount of force that is applied by the user 32 to move the first strap 36 and the second strap 38 through the adjustor 34. A height, area, size, or amount of the textured surface can be directly proportional to an amount of force needed to move or adjust the first strap 36 and the second strap 38. For example, an larger size or amount of the textured surface can require a larger amount of force to move or adjust the first strap 36 and the second strap 38 through the adjustor 34.

Figure 4B:
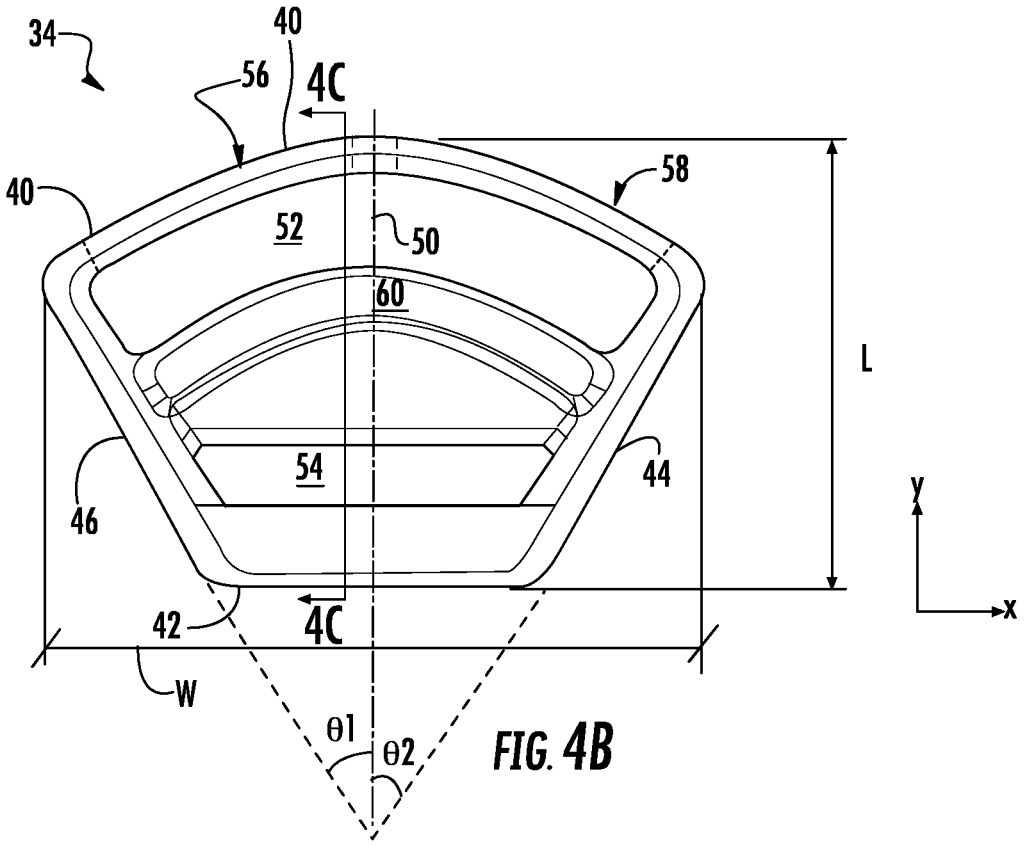

FIG. 4B shows a 2-dimensional schematic plan view of the top side 48 of the adjustor 34. The thickness T of the adjustor 34, when used in connection with helmets and helmet straps, can be in a range of 20-30 millimeters (mm), or 23-27 mm, or about 24 mm. As used herein, a dimension that is "about" is a value less than +/−30% of the dimension, +/−20% of the dimension, or +/−10% of the dimension, as well as less than +/−2 mm, or less than +/−1 mm of the dimension.

FIG. 4B also shows the first through opening 52 that extends completely through the strap adjustor 34 between the top surface 48, which can be referred to as a first surface, and the bottom surface 49, which can also be referred to a second surface. In some instances, the first through opening 52 can extend from the top surface 48 towards the bottom surface 49 and in some instance can do so without arriving at, or passing through, the second surface so that the first through opening passes partially, but not completely, through the adjustor 34. Similarly, the second through opening 54 can extend completely through the strap adjustor 34 between the top surface 48 and the bottom surface 49. In some instances, the second through opening 54 can extend through the strap adjustor 34 from the top surface 48 toward the bottom surface 49 and in some instance can do so without arriving at, or passing through, the second surface so that the first through opening passes partially, but not completely, through the adjustor 34. While the terms first, second, third, etc. are used herein for convenience, a person of ordinary skill in the art will understand that the identifiers first and second can be variously applied to other surfaces and openings as well.

Figure 4C:
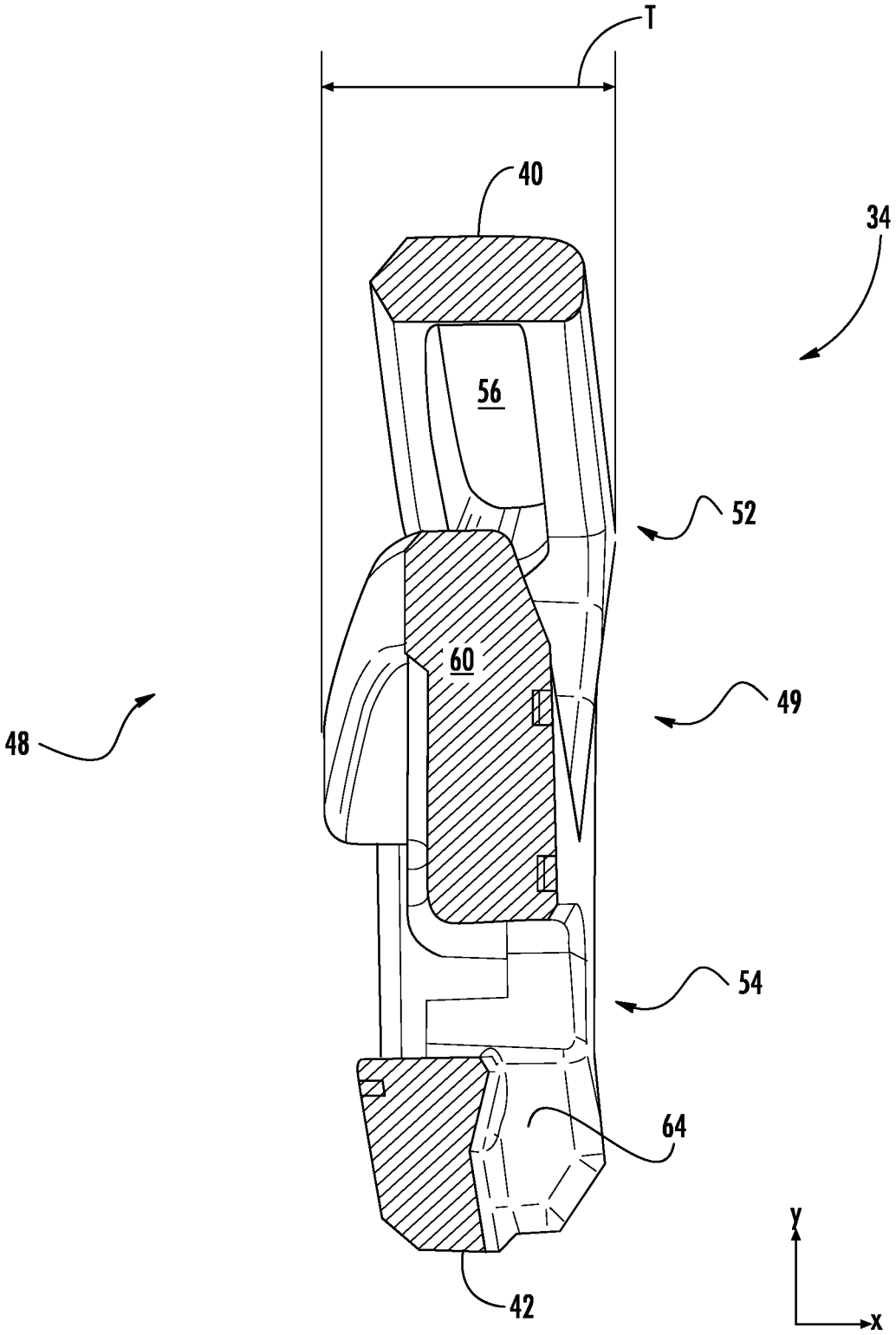
Figure 4D:
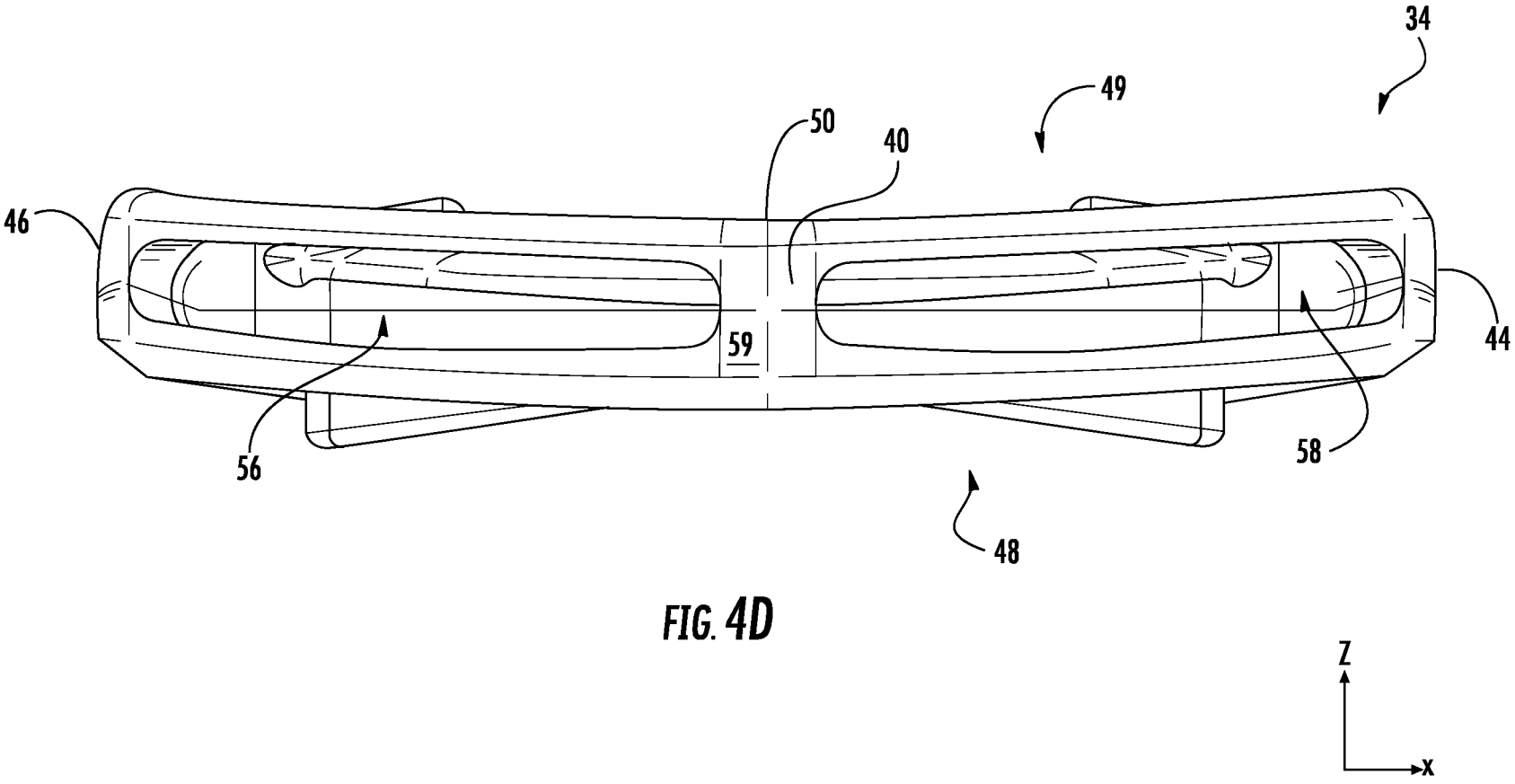
Figure 4E:
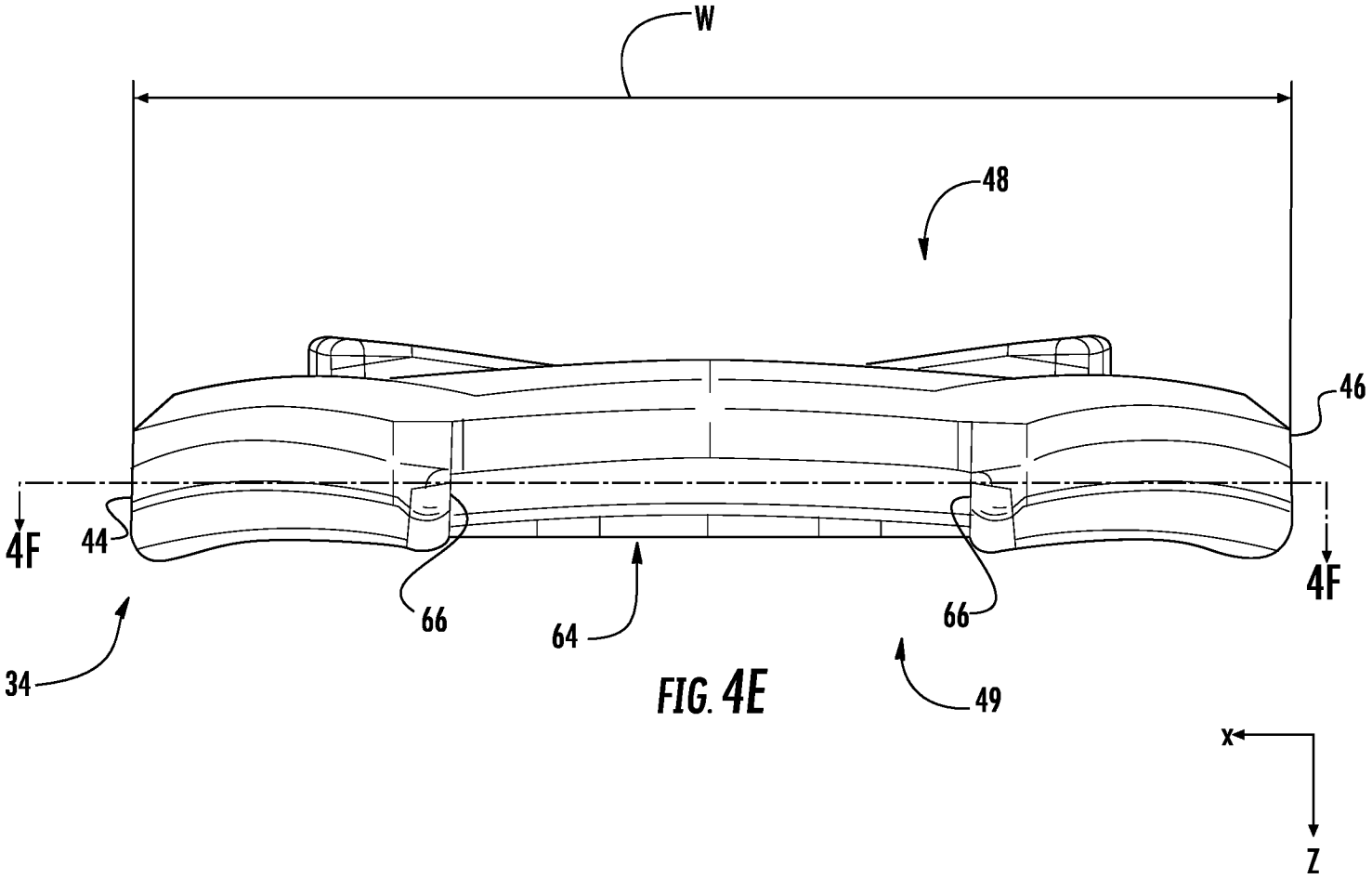
Figure 4F:
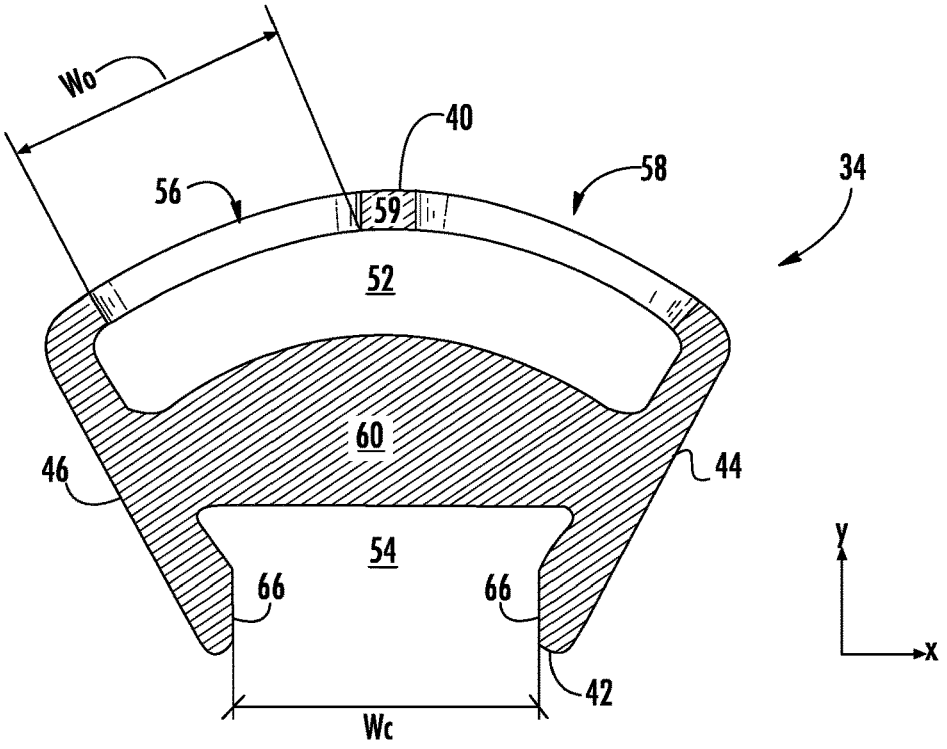

FIG. 4B, like FIG. 4F, also shows the additional detail of the first end opening 56 that extends from the upper (or third) surface 40 to the first through opening 52. Similarly, the second end opening 58 is also shown extending from the upper surface 40 to the first through opening 52. The first end opening 56 can be offset and separate from the second end opening 58. In some instances, the separation between the first end opening 56 and the second end opening 58 can be by a bar, strip, or connecting portion of material of the adjustor 34 that is aligned with the centerline 50. In some instances, the first end opening 56 and the second end opening 58 can extend to, and be substantially perpendicular with respect to, the first through opening 52. The first end opening 56 and the second end opening 58 can also be aligned with the angles of the frontside 44 and the backside 46 to accommodate a desired angle of entry of the first strap 36 and the second strap 38 into the adjustor 34.

FIG. 4B also shows a section line 4C-4C, which discloses the line along which the view of FIG. 4C is shown. FIG. 4C shows a cross-sectional profile view of the adjustor 34 taken along a section line A-A from FIG. 4B. The overall thickness, or depth T of the adjustor 34, as measured between the top side 48 and the bottom side 49 of the adjustor 34, can be in a range of 3-9 mm, or about 6-7 mm. Alternatively, the overall thickness T of the adjustor 34 can be a function of strap thickness, and can comprise a thickness 5-9 or 6-8 times a thickness of the straps passing through the adjustor 34.

FIG. 4C also shows the lower end 42 of the adjustor 34, which can also be referred to as a second end, comprising a channel, cutout, trough, trench, lane, or track 64, through which one or more straps, such as the first strap 36 and the second strap 38, can pass and exit the adjustor 34. The channel 64 can comprise a width of channel Wc, which can be measured as a distance between the opposing sidewalls 66. The straps can be similarly, identically, or substantially identically aligned with each other and with the centerline 50 of the adjustor 34 at least in part by the sidewalls 66 of the channel 64 that constrain and direct the straps out of the adjustor.

FIG. 4D shows a profile view of the upper surface or end 40 of the adjustor 34. The first end opening 56 and the second end opening 58 are also shown extending into the adjustor 34, the first end opening 56 and the second end opening 58 being separated by the centerline 50 and the separator 59.

FIG. 4E shows a profile view of the lower edge or surface 42 of the adjustor 34, opposite the view shown in FIG. 4D. An overall width W of the adjustor 34, as measured between the front side 44 and the backside 46 of the adjustor 34, can be in a range of 20-50 mm, or in a range of 30-40 mm, or about 35 mm. FIG. 4E also shows a section line 4F-4F, which discloses the line along which the view of FIG. 4F is shown.

FIG. 4F shows a cross-sectional plan view of the adjustor 34 taken along the section line 4F-4F shown in FIG. 4E. As such the view presented in FIG. 4F is similar to the view shown in FIG. 4B. FIG. 4F further shows the first end opening 56 and the second end opening 58 formed along the upper surface 40 of the adjustor 34. Furthermore, the upper surface 40 of the adjustor 34 can be of an area, size, length, or distance that is greater than an area, size, length, or distance of the lower surface 42 of the adjustor 34. Accordingly, a cumulative or collective size or area of the first end opening 56 and the second end opening 58 can be greater than a cumulative or collective size or area of the channel 64 or of one or more openings formed along the lower surface 42 of the adjustor 34.

As shown in the non-limiting example of the adjustor 34 of FIG. 4F, the adjustor 34 can be formed with first end opening 56 and second end opening 58. A width Wo of the first end opening 56 and the second end opening 58 can correspond to, and be slightly larger than, a width of the first strap 36 and the second strap 38, respectively, that will be inserted through the first end opening 56 and the second end opening 58. An overall width Wo of each of the first end opening 56 and second end opening 58, as measured along the upper surface 40, can be in a range of 5-40 mm, or in a range of 10-18 mm, or about 14 mm.

To accommodate the first strap 36 entering the first end opening 56 and the second strap 38 entering the second end opening 58 from different angles, the adjustor 34 can differ from conventional adjustors 10 by including a curved, angled, or arced shape along the upper surface 40 of the adjustor 34, including the first end opening 56 and the second end opening 58 comprising a curved, angled, or arced shape. The curved, angled, or arced shape of the upper surface 40 can allow for the first strap 36 and the second strap 38 to enter the adjustor 34 from different angles to enter the adjustor 34 without twisting, or with reduced twisting, outside, adjacent, or near the adjustor 34 when compared with conventional adjustors 10 as shown in FIG. 2. Instead, the pucker or twist of the first strap 36 or the second strap 38 can occur within the adjustor 34, which can eliminate twisting outside, adjacent, or near the adjustor 34. Thus, in some instances the adjustor 34 can work in a way that is similar to how a dart works in sewing, in that the adjustor 34 can create a triangular area within the adjustor 34 that allows the first strap 36 and the second strap 38 to curve to a desired shape, and eliminate the twist(s) 29 outside the adjustor 34. Additionally, by including the twist or pucker 29 of the straps within the adjustor 34, the adjustor 34 can be prevented from "creeping," "wandering" or sliding with respect to the straps. The lower edge 42 and the channel 64 can be formed with a straight or level edge that is not curved, angled, or arced shaped. The opening or channel 64 that is formed in the lower edge or surface 42 of the adjustor 34 can also be straight or level and not curved, angled, or arced shaped. As such, the lower strap opening or channel 64 can cause or facilitate the first strap 36 and the second strap 38 being aligned together to exit the adjustor 34 in a same or substantially the same direction from the adjustor 34, which can be desirable for user fit and comfort. In some instances the first strap 36 and the second strap 38 will exit at an angle equal or substantially equal to the centerline 50 of the adjustor 34.

Figure 4G:
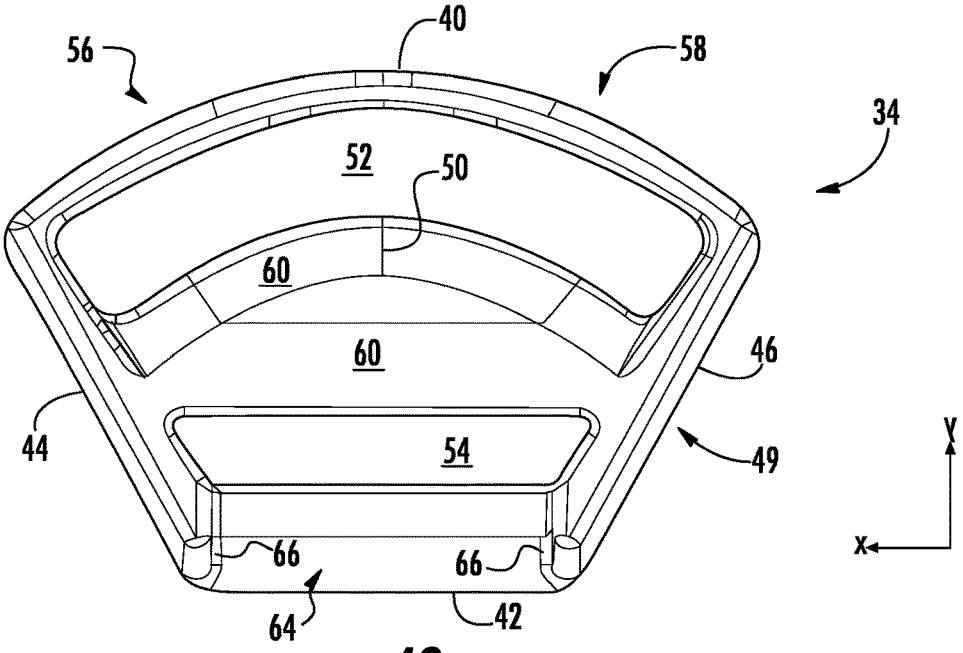

FIG. 4G shows a plan view of an embodiment of the adjustor 34 that shows the bottom surface 49 of the adjustor 34 opposite the top surface 48, and opposite the view shown in FIG. 4B.

Figure 4H:
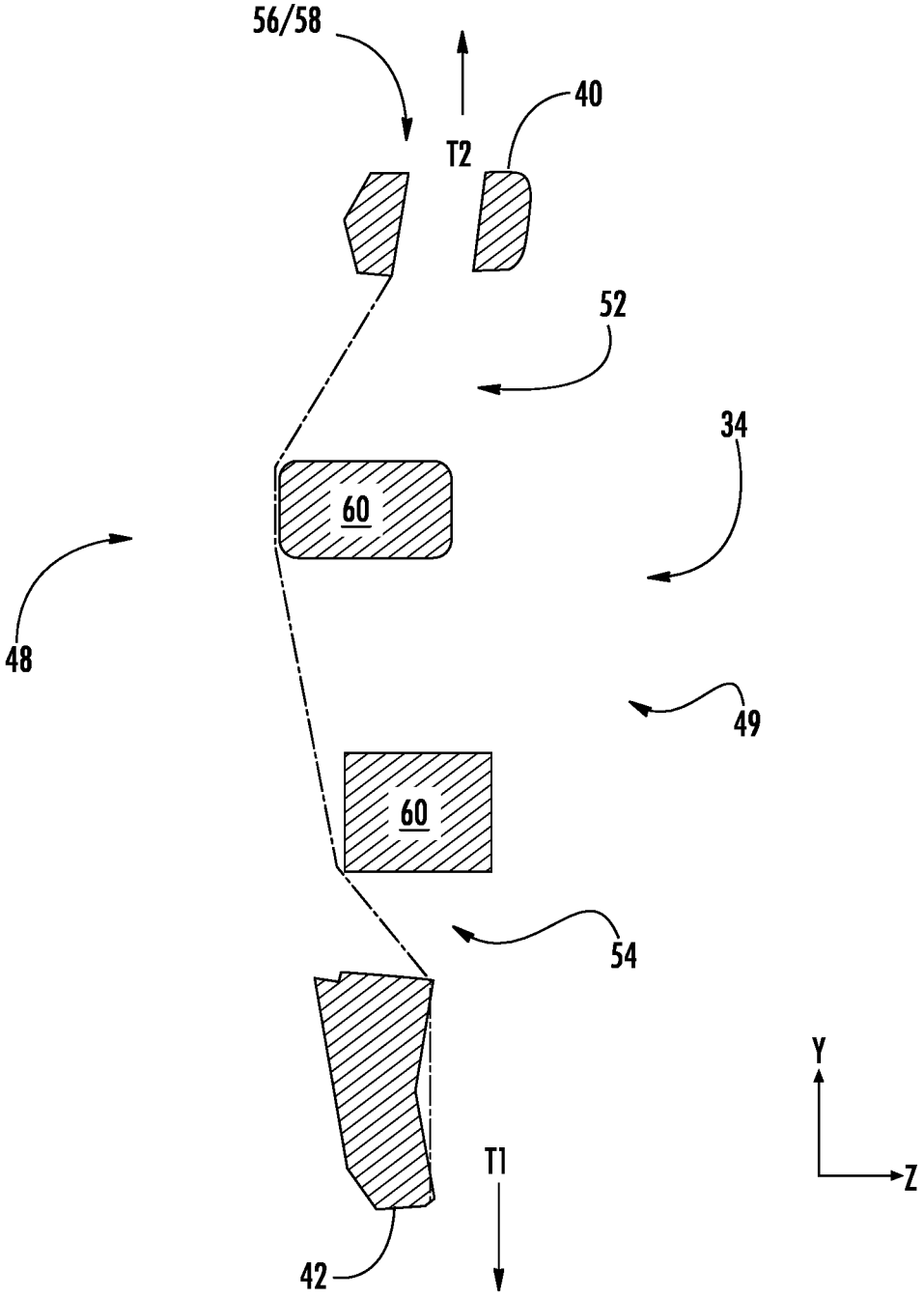
Figure 4I:
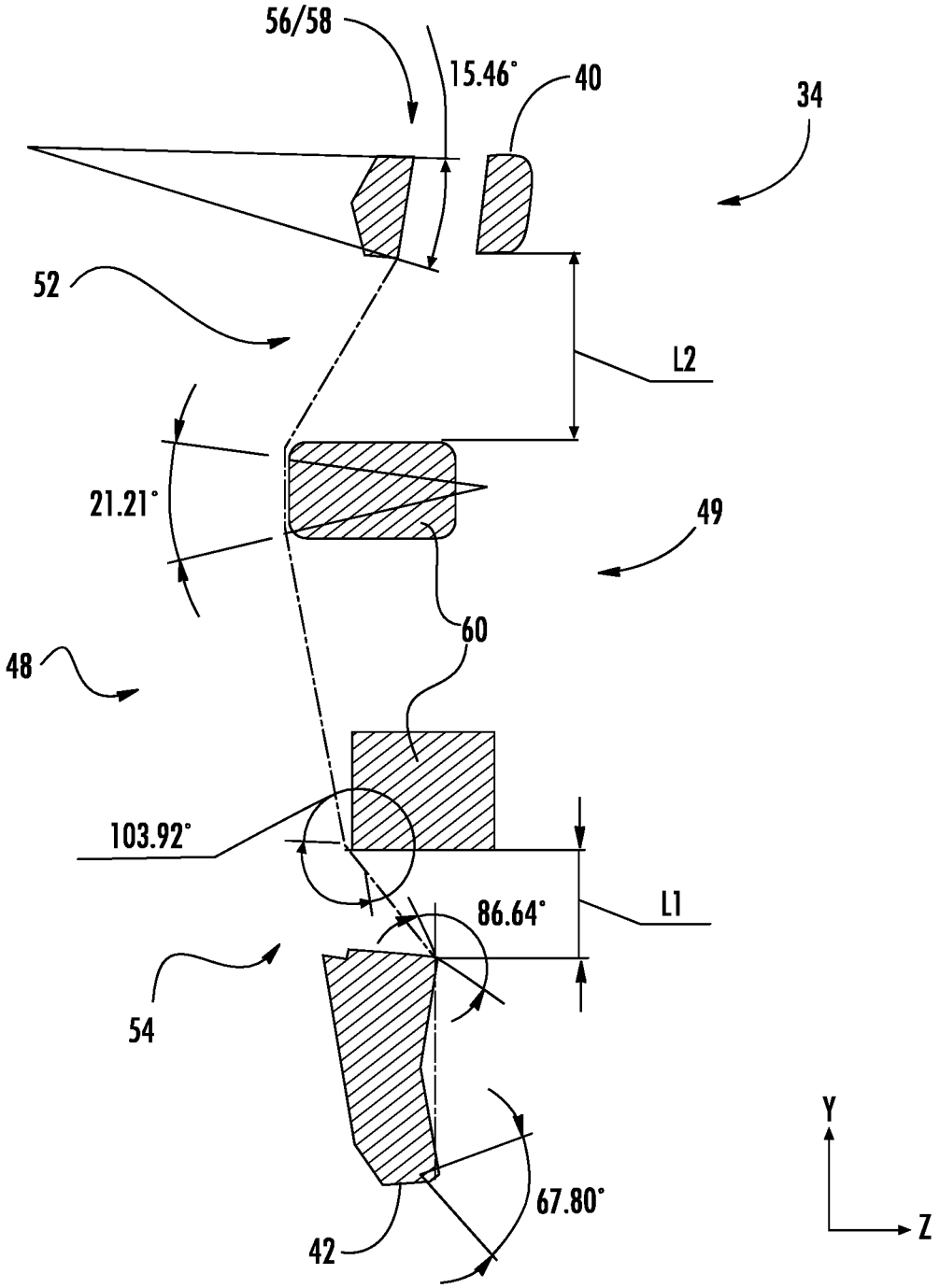

FIGS. 4H and 4I provide cross-sectional views of the adjustor 34 that can be views taken along a section line similar to section line 4C-4C shown in FIG. 4B. Applicant has recognized that the frictional forces acting on the straps or webbing under normal conditions of being threaded through the adjustor 34, could depend on an interaction of three variables, as set forth in the Capstan Equation. The Capstan equation is set forth below as equation one (EQ. 1).

$$T_2=T_1e^{\mu\beta} \qquad \text{EQ. 1}$$

Thus, the three variables presented in EQ. 1 are, first a force or amount of tension in the straps, which is represented by tension 1 (T1) and tension 2 (T2), as shown in FIG. 4H. Tension T1 can be directed away from the lower edge 42 of the adjustor 34 and toward a chin of the user 32. Tension T2 can be directed away from the upper edge 40 of the adjustor 34 and toward the helmet 30. Second, another variable or a coefficient of friction, μ, between the strap, such as first strap 36 or second strap 38, and the adjustor 34 in included in EQ. 1. Third, a total angle of contact, β, between the straps, such as first strap 36 or second strap 38, and the adjustor 34, in another variable included in the EQ. 1. An example of the total angle of contact β between the straps 36, 38 and the adjustor 34 is shown in FIG. 4I, and can include a value greater than 180°, or a value in a range of 180°-340°, in specific embodiments 275°-315°, in more specific embodiments 290°-300°, or, in particular embodiments, about 295°. However, any desirable value can be used as friction, material choice, geometry, aesthetics, and other factors are considered and selected for the adjustor 34 and the straps 36, 38.

The amount of force needed to adjust Applicant's adjustor 34 was made to be greater than the amount of force needed to adjust a conventional adjustor 10. Stated another way, the friction of Applicant's adjustor 34 was made to be greater than the friction a conventional adjustor 10. The amount of friction or force needed to adjust Applicant's adjustor 34 was increased by adding sharper angles of contact to increase the total angle of contact, β, and by increasing the surface area of the straps in contact with the adjustor 34. The amount of friction, and the force needed to adjust Applicant's adjustor 34, was also increased by decreasing the length or distance of spaces L1 and L2. As shown in FIG. 4I, the length L1 of the first through opening 52 is between the upper surface 40 and the bar 60. Similarly, the length L2 of the second through opening 54 is between the bar 60 and the channel 64 or the bottom lower edge 42. The changes to the spacing as well as the sharper angles serve to exponentially increase friction and to prevent "creep" of Applicant's adjustor 34 as compared to conventional adjustors 10, wherein creep occurs with respect to both first and second straps 36, 38 as well as the head or face of the user 32.

As understood with respect to the capstan equation, EQ. 1, pulling the adjustor 34 down with a force of T1 would create a large tensional force, T2, acting opposite T1, or on the upper part of the straps, 36, 38 thereby slowing a speed at which the straps 36, 38 would slide or move through the adjustor 34, as the adjustor 34 is being adjusted by the user. Thus, the adjustor 34 can stay in place without slipping or "creeping" by keeping the weight of the adjustor 34 below the sum of the normal and frictional forces of the adjustor 34 on the straps 36, 38 while the device is stationary, and maintaining reasonable tensional force when the adjustor 34 is being moved or repositioned. Furthermore, the adjustor 34 can be moved or repositioned along the straps with reasonable amounts of force from the user, and without undue difficulty, when formed as described herein.

In addition to accounting for size, weight, and an amount of force and friction applied to move or slide the adjustor 34, additional consideration was also given to an aerodynamic shape and a low profile fit of the adjustor 34 on the user 32. An aerodynamic, low profile design, including tapered leading and lagging edges can reduce drag, as well as reduce undesired noise resulting from the shape and position of the adjustor 34 with respect to the position and interaction of the adjustor 34 with the straps 36, 38.

Accordingly, the adjustor 34 provides a number of advantages with respect to conventional adjustors 10. By forming the adjustor 34 as shown in FIGS. 3-4I, a problem of a "creeping" adjustors 10 that shift position over time with respect to the straps 26, 28 that pass through the adjustor 10, will be reduced or even eliminated because of the improved geometry of the adjustor 34 in accommodating straps 36, 38. Specifically, by including the twist or pucker of the straps 36, 38 within the adjustor 34 (as apposed to outside, adjacent, or near the adjustor 34), the adjustor 34 can be prevented from creeping because of a force applied to the adjustor 34 from the strap, or a force applied to the strap from the adjustor 34. Additionally, with the strap pucker or twist contained within the adjustor 34, the adjustor 34 can reduce or prevent the webbing from twisting along the rider's face. In fact, twisting of the straps higher than the upper edge and lower than the lower edge can be reduced or eliminated. In some embodiments, twisting located higher than the upper edge of the adjustor 34 can be controlled by the first end opening 56 and the second end opening 58 being formed along the upper surface or edge 40 of the adjustor 34 by keeping the straps 36, 38 neatly separated and lying flat along the face of the user 32. Similarly, twisting located lower than the lower edge 42 of the adjustor 34 can be controlled by the channel 64 formed along the lower surface or edge 42 of the adjustor 34 by keeping the plurality of straps 36, 38 neatly aligned and lying flat along the face of the user 32.

While the advantages have been discussed with respect to conventional adjustors 10, or adjustors comprising three bars, similar advantages can also be achieved by including multiple upper openings or an upper edge that is curved, angled, or arced for other adjustors, including 4 bar adjustors, ladder lock adjustors, connectors, buckles, or other similar devices.

Where the above examples, embodiments and implementations reference examples, it will be understood by those of ordinary skill in the art that other helmet and manufacturing devices and examples could be intermixed or substituted with those provided as virtually any components consistent with the intended operation of a method, system, or implementation may be utilized. Accordingly, for example, although particular component examples may be disclosed, such components may be comprised of any shape, size, style, type, model, version, class, grade, measurement, concentration, material, weight, quantity, and/or the like consistent with the intended purpose, method and/or system of implementation. In places where the description above refers to particular embodiments of strap adjustors for helmets, it should be readily apparent that a number of modifications may be made without departing from the spirit thereof and that these embodiments and implementations may be applied to other to gear and equipment technologies as well. Accordingly, the disclosed subject matter is intended to embrace all such alterations, modifications, and variations that fall within the spirit and scope of the disclosure and the knowledge of one of ordinary skill in the art. The presently disclosed embodiments are, therefore, to be considered in all respects as illustrative and not restrictive.

What is claimed is:

1. A strap adjustor, comprising:

a top surface and a bottom surface opposite the top surface;

an upper surface that extends between the top surface and the bottom surface and a lower surface opposite the upper surface;

a front surface extending between the top surface and the bottom surface and between the upper surface and the lower surface and a back surface opposite the front surface, the back surface extending between the top surface and the bottom surface and between the upper surface and the lower surface;

a first through opening, between the front surface and the back surface, that extends completely through the strap adjustor;

a second through opening, between the front surface and the back surface, that extends completely through the strap adjustor;

a bar separating the first through opening from the second through opening, the bar extending from the top surface to the bottom surface and from the front surface to the back surface;

a first end opening contained within the upper surface, the first end opening extending from the upper surface to the first through opening; and a second end opening contained within the upper surface adjacent to but separate from the first end opening, the second end opening extending from the upper surface to the first through opening.

2. The strap adjustor of claim 1, wherein the second end opening is offset and separate from the first end opening.

3. The strap adjustor of claim 2, further comprising:

a first strap configured to extend from a helmet to the first end opening and to be disposed through the first end opening, through the first through opening, and over the bar; and a second strap configured to extend from the helmet to the second end opening and to be disposed through the second end opening, through the first through opening, and over the bar.

4. The strap adjustor of claim 3, further comprising:

an end opposite the third surface, the end comprising a channel; and the first strap and the second strap being disposed through the channel.

5. The strap adjustor of claim 3, wherein total angle of contact β between the first strap and the strap adjustor comprises an angle in a range of 280°-310°.

6. The strap adjustor of claim 1, further comprising a first strap entering the first end opening at an angle substantially equal to an average angle of a first sidewall relative to a longitudinal axis of the strap adjuster;

a second strap entering the second end opening at an angle substantially equal to an average angle of a second sidewall relative to the longitudinal axis of the strap adjuster; and the first strap and the second strap exiting the strap adjustor in a direction substantially aligned with the longitudinal axis of the strap adjustor.

7. A strap adjustor, comprising:

a top surface and a bottom surface opposite the top surface;

an upper surface that extends between the top surface and the bottom surface and a lower surface opposite the upper surface;

a front surface extending between the top surface and the bottom surface and between the upper surface and the lower surface and a back surface opposite the front surface, the back surface extending between the top surface and the bottom surface and between the upper surface and the lower surface;

a first through opening, between the front surface and the back surface, that extends completely through the strap adjustor;

a second through opening, between the front surface and the back surface, that extends completely through the strap adjustor;

a bar separating the first through opening from the second through opening, the bar extending from the top surface to the bottom surface and from the front surface to the back surface;

a first end opening positioned on the upper surface, the first end opening extending from the upper surface to the first through opening; and a second end opening positioned on the upper surface adjacent to but separate from the first end opening, the second end opening extending from the upper surface to the first through opening;

wherein a width of the strap adjustor tapers from the upper surface to the lower surface such that the upper surface is wider than the lower surface.

8. The strap adjustor of claim 7, wherein the second end opening is offset and separate from the first end opening.

9. The strap adjustor of claim 8, further comprising:

a first strap configured to extend from a helmet to the first end opening and to be disposed through the first end opening, through the first through opening, and over the bar; and a second strap configured to extend from the helmet to the second end opening and to be disposed through the second end opening, through the first through opening, and over the bar.

10. The strap adjustor of claim 9, further comprising:

an end opposite the third surface, the end comprising a channel; and the first strap and the second strap being disposed through the channel.

11. The strap adjustor of claim 9, wherein total angle of contact between the first strap and the strap adjustor comprises an angle in a range of 280° -310° .

12. The strap adjustor of claim 7, further comprising:

a first strap entering the first end opening at an angle substantially equal to an average angle of a first sidewall relative to a longitudinal axis of the strap adjuster;

a second strap entering the second end opening at an angle substantially equal to an average angle of a second sidewall relative to the longitudinal axis of the strap adjuster;

the first strap and the second strap exiting the strap adjustor in a direction substantially aligned with the longitudinal axis of the strap adjustor; and the first strap and the second strap exiting the strap adjustor in a direction substantially aligned with the longitudinal axis of the strap adjustor.

13. A strap adjustor, comprising:

a top surface and a bottom surface opposite the top surface;

an upper surface that extends between the top surface and the bottom surface and a lower surface opposite the upper surface;

a front surface extending between the top surface and the bottom surface and between the upper surface and the lower surface and a back surface opposite the front surface, the back surface extending between the top surface and the bottom surface and between the upper surface and the lower surface;

a first through opening, between the front surface and the back surface, that extends completely through the strap adjustor;

a second through opening, between the front surface and the back surface, that extends completely through the strap adjustor;

a bar separating the first through opening from the second through opening, the bar extending from the top surface to the bottom surface and from the front surface to the back surface, wherein a thickness of the bar varies from a maximum thickness proximate to the front surface and the back surface to a minimum thickness at a center of the bar;

a first end opening positioned on the upper surface, the first end opening extending from the upper surface to the first through opening; and a second end opening positioned on the upper surface adjacent to but separate from the first end opening, the second end opening extending from the upper surface to the first through opening.

14. The strap adjustor of claim 13, wherein the second end opening is offset and separate from the first end opening.

15. The strap adjustor of claim 14, further comprising:

a first strap configured to extend from a helmet to the first end opening and to be disposed through the first end opening, through the first through opening, and over the bar; and a second strap configured to extend from the helmet to the second end opening and to be disposed through the second end opening, through the first through opening, and over the bar.

16. The strap adjustor of claim 15, further comprising:

an end opposite the third surface, the end comprising a channel; and the first strap and the second strap being disposed through the channel.

17. The strap adjustor of claim 15, wherein total angle of contact β between the first strap and the strap adjustor comprises an angle in a range of 280° -310° .

18. The strap adjustor of claim 13, further comprising:

a first strap entering the first end opening at an angle substantially equal to an average angle of a first sidewall relative to a longitudinal axis of the strap adjuster;

a second strap entering the second end opening at an angle substantially equal to an average angle of a second sidewall relative to the longitudinal axis of the strap adjuster;

the first strap and the second strap exiting the strap adjustor in a direction substantially aligned with the longitudinal axis of the strap adjustor; and the first strap and the second strap exiting the strap adjustor in a direction substantially aligned with the longitudinal axis of the strap adjustor.

* * * * *